US007856973B2

(12) United States Patent
Kim et al.

(10) Patent No.: US 7,856,973 B2
(45) Date of Patent: Dec. 28, 2010

(54) COOKING APPLIANCE

(75) Inventors: Jong Sik Kim, Seoul (KR); Yang Kyeong Kim, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 1026 days.

(21) Appl. No.: 11/609,041

(22) Filed: Dec. 11, 2006

(65) Prior Publication Data

US 2007/0131220 A1 Jun. 14, 2007

(30) Foreign Application Priority Data

Dec. 12, 2005 (KR) ..... 10-2005-0121829

(51) Int. Cl.
*F24C 15/32* (2006.01)

(52) U.S. Cl. ..... 126/273 R; 126/21 A; 126/198; 126/193

(58) Field of Classification Search ..... 126/273 R, 126/21 A, 198, 193, 200; 415/199.1, 199.2, 415/199.3, 198.1
See application file for complete search history.

(56) References Cited

U.S. PATENT DOCUMENTS 6,904,904 B2 * 6/2005 Walther et al. ..... 126/198
2005/0133019 A1 6/2005 Kim et al.
2006/0225727 A1 10/2006 Kim et al.
2006/0237425 A1 10/2006 Kim et al.

FOREIGN PATENT DOCUMENTS

GB 2098274 * 11/1982
KR 20-0253287 10/2001
KR 10-2004-0061390 7/2004

* cited by examiner

*Primary Examiner*—Alfred Basichas
(74) *Attorney, Agent, or Firm*—McKenna Long & Aldridge LLP

(57) ABSTRACT

A cooking appliance is provided that has a structure which efficiently cools an electric element chamber. The cooking appliance includes an appliance body that has a cooking chamber to cook food, a door that opens and closes the cooking chamber, and cooling flow passages that absorb heat transferred from the cooking chamber. Additionally, an intake air duct may be provided proximate a top side of the cooking chamber to communicate with the cooling flow passages. Further, an exhaust duct may be provided proximate the intake air duct to communicate with the intake air duct. Further, a fan-motor assembly may be provided in a space formed by the intake air duct and the exhaust duct such that the fan-motor assembly forms a portion of a connecting passage that connects the intake air duct and the exhaust duct.

17 Claims, 5 Drawing Sheets

COOKING APPLIANCE

This application claims the benefit of Korean Patent Application No. 10-2005-0121829, filed on Dec. 12, 2005, which is hereby incorporated by reference as if fully set forth herein.

BACKGROUND OF THE INVENTION

1. Field of the Invention

The present invention relates to a cooking appliance, and more particularly, to a cooking appliance having a structure capable of efficiently cooling elements received in an electric element chamber.

2. Discussion of the Related Art

Generally, for cooking appliances, various products such as an oven and a microwave oven are known. The microwave oven is an appliance for cooking food using a magnetron alone or together with a heater. On the other hand, the oven is a cooking appliance designed to boil food using a dry heat by heating the food in a sealed chamber. In this case, electricity, gas, or the like is used as a heat source for supplying heat to the food.

In particular, electric ovens are favorable to consumers because they have a security against fire by virtue of no generation of flames, and exhibit a high thermal efficiency.

In conventional cooking appliances, a blowing fan is used to cool an electronic element chamber where a variety of electric or electronic elements are installed. In such conventional cooking appliances, however, there is a problem in that the electric element chamber cannot be efficiently cooled because a motor for driving the blowing fan is arranged in a flow path of blown air.

Furthermore, the blowing fan equipped in the conventional cooking appliances has a drawback of a degradation in energy efficiency because it directly sucks a flow of heated air present in a cooking chamber.

Meanwhile, in the case of a built-in type cooking appliance, generally, it is installed in a cabinet which is made of wood in most cases.

In this case, the cabinet may be heated during a procedure for outwardly discharging exhaust by the blowing fan because the exhaust, which is relatively hot, strikes a structure such as a door or exhaust duct of the cooking appliance, so that heat transfer occurs between the exhaust and the structure. As a result, there is a problem in that the cabinet may be distorted.

SUMMARY OF THE INVENTION

Accordingly, the present invention is directed to a cooking appliance that substantially obviates one or more problems due to limitations and disadvantages of the related art.

An object of the present invention is to provide a cooking appliance having a structure capable of efficiently cooling elements received in an electric element chamber.

Another object of the present invention is to provide a cooking appliance capable of achieving an increase in energy efficiency.

Still another object of the present invention is to provide a cooking appliance capable of reducing thermal damage applied to a cabinet receiving the cooking appliance when the cooking appliance is of a built-in type.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cooking appliance includes an appliance body defining a cooking chamber for cooking food; a door for opening or closing the cooking chamber, the door having cooling flow passages for absorbing heat transferred from the cooking chamber; an intake air duct communicating with the cooling flow passages, the intake air duct being arranged on a top of the cooking chamber; an exhaust duct communicating with the intake air duct, the exhaust duct being arranged to be neighboring to the intake air duct; and a fan-motor assembly arranged in a space defined by the intake air duct and the exhaust duct such that the fan-motor assembly forms a portion of a connecting passage connecting the intake air duct and the exhaust duct.

The fan-motor assembly may include an intake air fan arranged in the intake air duct, an exhaust fan arranged in the exhaust duct, and a bi-axial motor for driving the intake air fan and the exhaust fan.

The intake air duct and the exhaust duct may be vertically arranged to form a layered structure.

The exhaust duct may have a straight portion extending to a predetermined length at an outlet end of the exhaust duct, to prevent diffusion of air outwardly discharged from the exhaust duct.

The fan-motor assembly may further include a fan housing for forming the connecting passage, and receiving the exhaust fan and the intake air fan.

The fan-motor assembly may further include flow guides arranged around the intake air fan and the exhaust fan, respectively, to guide flows of air generated by the intake air fan and the exhaust fan, respectively.

The fan-motor assembly may further include a fan guide arranged between the intake air fan and the exhaust fan, to separate air introduced into the intake air fan and air introduced into the exhaust fan from each other.

The cooking appliance may further include an electric element chamber defined over the cooking chamber, and adapted to receive elements required for an operation of the cooking appliance, and an intake louver for communicating an interior of the fan housing and the electric element chamber.

The cooking appliance may further include a rear intake air duct arranged between a back plate forming a rear wall of the appliance body and a rear wall of the cooking chamber.

The rear intake air duct may have an inner space independent of a space defined between the back plate and the rear wall of the cooking chamber.

The cooking appliance may further include an intake louver for communicating the rear intake air duct and an inner space of the fan housing.

The rear intake air duct may have a cooling louver for communicating an inner space of the rear intake air duct to ambient air.

The cooking appliance may further include a bottom duct arranged beneath a bottom of the cooking chamber, the bottom duct communicating with ambient air and with the rear intake air duct.

The cooking appliance may further include an ambient air intake louver functioning as an introduction passage for guiding ambient air to be introduced into the electric element chamber through an upper portion of the electric element chamber.

The ambient air intake louver may be arranged between a control panel mounted to a front wall of the electric element chamber and a top plate forming a top wall of the electric element chamber.

The top plate may have a stepped end in a region where the ambient air intake louver is arranged, to prevent water form being externally introduced into the electric element chamber through the ambient air intake louver.

The door may include a door frame, and a plurality of spaced glasses fitted in the door frame. In this case, the cooling flow passages may be defined by the plurality of glasses and the door frame.

It is to be understood that both the foregoing general description and the following detailed description of the present invention are exemplary and explanatory and are intended to provide further explanation of the invention as claimed.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

Figure 1:
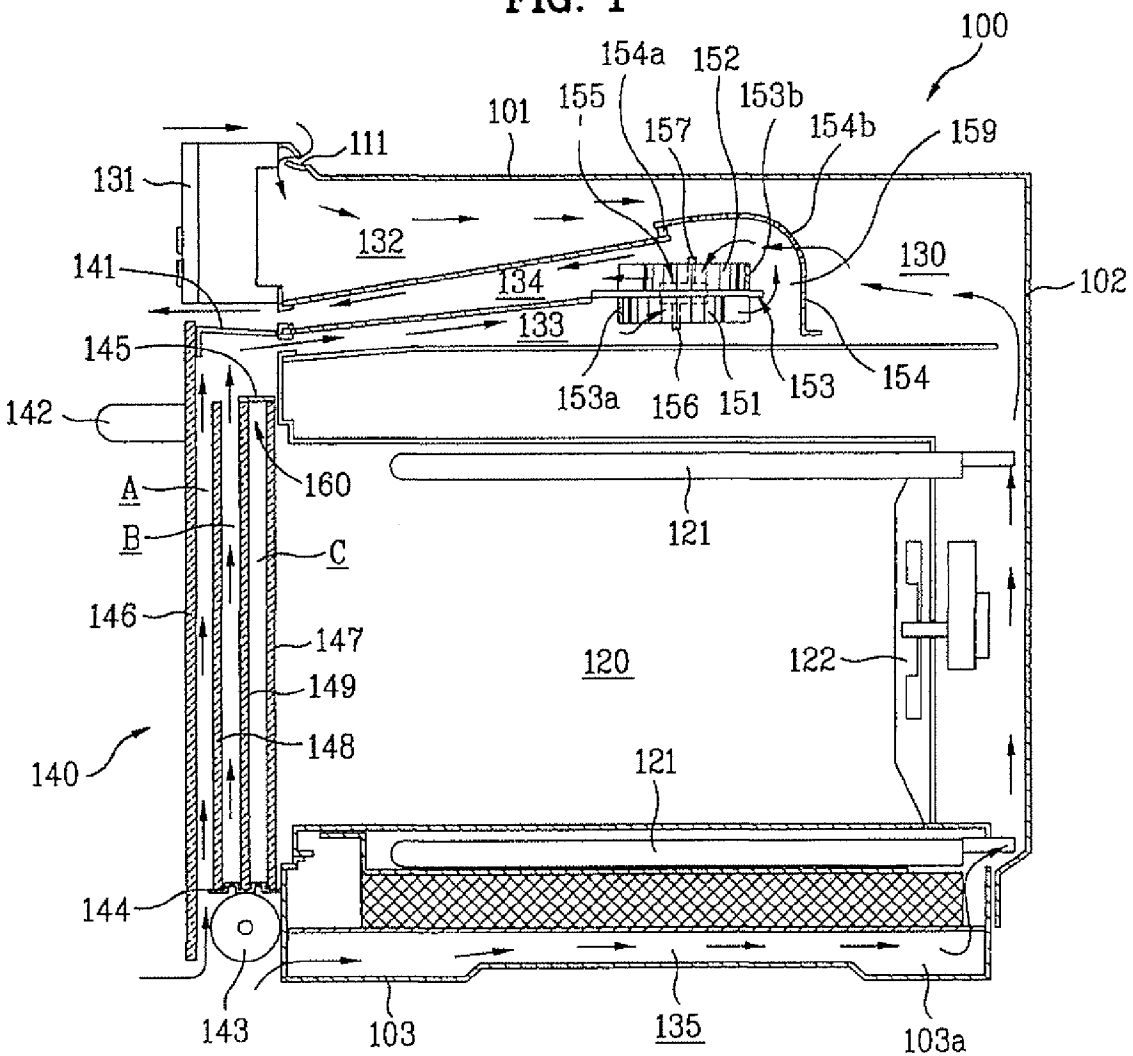
FIG. 1 is a sectional view illustrating an essential part of a cooking appliance according to an exemplary embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail to the preferred embodiments of the present invention, examples of which are illustrated in the accompanying drawings. Wherever possible, the same reference numbers will be used throughout the drawings to refer to the same or like parts.

Hereinafter, a cooking appliance according to an exemplary embodiment of the present invention will be described with reference to FIG. 1.

The cooking appliance includes an appliance body 100 defining therein a cooking chamber 120 as a space where food is cooked, a door 140 for opening or closing the cooking chamber 120, an intake air duct 133 connected to the top of the cooking chamber 120, and an exhaust duct 134 neighboring (i.e., proximate) the intake air duct 133. The cooking appliance also includes a fan-motor assembly arranged (or provided) in a space defined (or formed) by the intake air duct 133 and exhaust duct 134 such that the fan-motor assembly forms a portion of a connecting passage 159 connecting the intake air duct 133 and exhaust duct 134.

The appliance body 100 forms an appearance of the cooking appliance. The cooking chamber 120, which is provided in the appliance body 100, forms a certain space to receive food to be cooked, and to cook the received food.

The door 140 may be mounted to a front wall of the appliance body 100, to selectively open or close the cooking chamber 120. In the appliance body 100, an electric element chamber 130 may be provided above the cooking chamber 120, to receive desired electric or electronic elements.

The appliance body 100 may have a generally rectangular parallelepiped structure. In detail, the appliance body 100 may include a top plate 101 forming a top wall of the appliance body 100, a back plate 102 forming a rear wall of the appliance body 100, a base plate 103 forming a bottom wall of the appliance body 100, and a control panel 131 arranged over (or provided above) the door 140 while forming a front wall of the electric element chamber 130.

Heaters 121 are installed in the cooking chamber 120 at desired positions (for example, top and bottom surfaces), to heat food received in the cooking chamber 120, and thus, to cook the food. A convection fan 122 may be mounted to a rear surface of the cooking chamber 120, to force air present in the cooking chamber 120 to flow within the cooking chamber 120, and thus, to cause heat generated from the heaters 121 to be uniformly transferred to the overall interior portion of the cooking chamber 120.

For each heater 121, a ceramic heater, a halogen heater, a grill heater, or the like may be used.

In the electric element chamber 130, electric or electronic elements such as a printed circuit board (PCB) for controlling the overall function of the cooking appliance may be installed. The control panel 131 may be electrically connected to the electric or electronic elements installed in the electric element chamber 130, in order to enable the user to input a command for an operation of the cooking appliance, and to recognize the operation.

The fan-motor assembly includes an intake air fan 151 arranged (or provided) in the intake air duct 133, an exhaust fan 152 arranged (or provided) in the exhaust duct 134, and a bi-axial motor 155 including two drive shafts 156 and 157 to drive the intake air fan 151 and exhaust fan 152.

The intake air fan 151 and exhaust fan 152 operate to supply ambient air introduced through the intake air duct 133 to the electric element chamber 130, and thus, to cool the electric element chamber 130 and the electric or electronic elements (not shown) installed in the electric element chamber 130. The intake air fan 151 and exhaust fan 152 also guide the air from the electric element chamber 130 to the exhaust duct 134, and thus, force the air, namely, exhaust, to be outwardly discharged.

Each of the intake air fan 151 and exhaust fan 152 may be a centrifugal fan which axially sucks air, and then circumferentially discharges the sucked air. Of course, for the intake air fan 151 and exhaust fan 152, any fans may be used, e.g., fans arranged to be neighboring (or proximate) to each other may be employed.

The intake air fan 151 and exhaust fan 152 may be coupled to the drive shafts 156 and 157 of the bi-axial motor 155, respectively, so that they are simultaneously driven by one bi-axial motor. The drive shafts 156 and 157 may extend from the bi-directional motor 155 in opposite directions, namely, upward and downward directions, respectively, and may be connected to the exhaust fan 152 at the upper side of the bi-directional motor 155 and to the intake air fan 151 at the lower side of bi-directional motor 155, respectively.

Of course, the intake air fan 151 and exhaust fan 152 may be driven by separate motors which may be vertically arranged (i.e., positioned vertically with respect to each other to form a layered structure), respectively.

For example, the intake air duct 133 and exhaust duct 134 may be arranged to be vertically neighboring to each other, and may be connected to each other by the connecting passage 159. The connecting passage 159 may be defined (or formed) by a fan housing 154 which receives the intake air fan 151 and exhaust fan 152.

Air introduced into the intake air duct 133 circulates the interior of the fan housing 154 after being discharged out of the intake air fan 151, and then enters the exhaust fan 152. The air may then be introduced into the exhaust duct 134. Accordingly, the fan housing 154 not only receives both the intake air fan 151 and the exhaust fan 152, but also functions to guide air discharged out of the intake air fan 151 to the exhaust fan 152.

The intake air duct 133 communicates, at one end thereof, with cooling flow passages A, B, and C defined (or provided) in the door 140, and communicates, at the other end thereof, with the connecting passage 159. On the other hand, the exhaust duct 134 communicates, at one end thereof, with the connecting passage 159, and communicates, at the other end thereof, with the ambient air. In particular, the end of the exhaust duct 134 communicating with ambient air may be arranged between an upper end of the door 140 and a lower end of the control panel 131.

The fan housing 154 includes a first intake louver 154*a* (i.e., a fan housing front intake louver) for allowing air present in the electric element chamber 130 to be directly introduced into the interior of the fan housing 154.

The door 140 includes a door frame 141 forming an outer periphery of the door 140 and an appearance of the door 140, a handle 142 mounted to an upper portion of a front wall of the door 140, to enable the user to selectively open or close the door 140, and a hinge 143 for hingably mounting the door 140 to a lower end of the appliance body 100.

A plurality of glasses 146, 147, 148, and 149 are fitted in the door frame 141, in order to prevent heat generated in the cooking chamber 120 from being outwardly transferred while enabling the user to view the interior of the cooking chamber 120.

The glasses 146, 147, 148, and 149 include an outer glass 146 substantially forming an outer wall of the door 140, namely, the front wall of the door 140, an inner glass 147 forming an inner wall, namely, a rear wall, of the door 140, and at least one intermediate glass arranged between the outer glass 146 and the inner glass 147.

In particular, in the illustrated embodiment, there are two intermediate glasses 148 and 149. Of the intermediate glasses 148 and 149, the glass arranged near the outer glass 146 will be referred to as a "first intermediate glass 148", and the glass arranged near the inner glass 147 will be referred to as a "second intermediate glass 149".

Although a total of four glasses including two intermediate glasses 148 and 149 are installed in the illustrated embodiment, the number of glasses is not limited thereto.

An opening or a slot may be formed through the lower end of the door 140, in order to allow ambient air to be introduced into the interior of the door 140. The cooling flow passages A, B, and C, which are defined (or provided) in the door 140, function to guide ambient air introduced into the interior of the door 140 through the opening or slot at the lower end of the door 140 such that the introduced air flows through the interior of the door 140.

In detail, the cooling flow passages A, B, and C may be defined (or provided) by the multiple glasses 146, 147, 148, and 149, and a portion of the door frame 141 arranged above the glasses 146, 147, 148, and 149.

In the following description, the cooling flow passages A, B, and C will be sequentially referred to as a "first cooling flow passage A" (namely, the cooling flow passage defined (or formed) between the outer glass 146 and the first intermediate glass 148), a "second cooling flow passage B", and a "third cooling flow passage C", respectively, in the installation order thereof corresponding to the installation order of the glasses 146, 147, 148, and 149, from the outside of the door 140 to the inside of the door 140.

The first and second cooling flow passage A and B communicate with the intake air duct 133 at an upper end of the door 140. Accordingly, cold ambient air introduced into the door 140 at the lower end of the door 140 flows upwardly along the first and second cooling flow passages A and B to the upper end of the door 140, and then enters the intake air duct 133.

Preferably, the cooling flow passages A, B, and C may be formed using the spaces among the glasses 146, 147, 148, and 149, without being formed using a separate structure.

In particular, it is preferred that the cooling flow passages A, B, and C be formed to enable air to flow along regions each defined between adjacent surfaces of the glasses 146, 147, 148, and 149. In this case, although the door 140 and glasses 146, 147, 148, and 149 may be heated due to heat transfer occurring in the cooking chamber 120, the glasses 146, 147, 148, and 149 can be cooled by cold ambient air flowing along the cooling flow passages A, B, and C. Accordingly, it is possible to remove a danger that the user may get burned.

The third cooling flow passage C may selectively form a sealed space, to provide a thermal insulating space between the second intermediate glass 149 and the inner glass 147. Accordingly, it is possible to enhance the efficiency of preventing heat transfer from occurring in the cooking chamber 120, and to minimize heat loss in the cooking chamber 120.

In order to selectively close or open the third cooling flow passage C, passage opening/closing members 144 and 145 may be mounted to upper and lower ends of the inner glass 147, respectively.

Although not shown, a gasket may be fitted around a front peripheral edge of the cooking chamber 120 contacting the door 140. When the door 140 is closed, it comes into close contact with the gasket, thereby preventing hot air from being outwardly leaked from the cooking chamber 120.

An ambient air intake louver 111 may be arranged in a region (i.e., proximate) where the top plate 101 and control panel 131 may be coupled to each other, in order to receive ambient air. When the intake air fan 151 and exhaust fan 152 may be driven, ambient air may be introduced into the electric element chamber 130 via the ambient air intake louver 111. The introduced ambient air may then be introduced into the interior of the fan housing 154 via the first intake louver 154*a* provided at the fan housing 154.

The ambient air introduced into the fan housing 154 may be outwardly discharged via the exhaust duct 134 after passing through the exhaust fan 152. Thus, the cold ambient air introduced into the electric element chamber 130 cools the electric element chamber 130 while passing through the electric element chamber 130 before being introduced into the fan housing 154.

In the illustrated embodiment, in order to enable ambient air introduced through the ambient air intake louver 111 to flow uniformly through the overall portion of the electric element chamber 130, the ambient air intake louver 111 may be arranged in the region where the top plate 101 and control panel 131 may be coupled to each other, at the front side of the cooking appliance, because the intake air fan 151 and exhaust fan 152 may be arranged at the rear side of the cooking appliance. However, the position of the ambient air intake louver 111 is not limited to the above-described position.

For example, the ambient air intake louver 111 may be arranged in a region where the top plate 101 and back plate 102 may be coupled to each other. On the other hand, where a plurality of top plates 101 are used, a plurality of ambient air intake louvers 111 may be arranged in regions where the top plates 101 are coupled to the back plate 102, respectively.

Hereinafter, the intake air duct 133 and exhaust duct 134 according to the present invention will be described in detail with reference to FIGS. 2 and 3.

Each of the intake air duct 133 and exhaust duct 134 may be connected, at one end thereof, to an associated one of the intake air fan 151 and exhaust fan 152. Each of the intake air duct 133 and exhaust duct 134 also communicates with a region defined between the door 140 and the control panel 131.

The intake air duct 133 communicates with the first and second cooling flow passages A and B of the door 140, and guides ambient air emerging from the first and second cooling flow passages A and B to the intake air fan 151.

The exhaust duct 134 guides air discharged from the exhaust fan 152, namely, exhaust, to the upper end of the door 140, to outwardly discharge the exhaust. In the illustrated case, the intake air duct 133 and exhaust duct 134 may be vertically arranged to form a double-layer structure. That is, the intake air duct 133 may be arranged beneath the exhaust duct 134 because the intake air duct 133 should communicate with the first and second cooling flow passages A and B.

The air discharged from the exhaust fan 152, namely, the exhaust, may be widely diffused at the end of the exhaust duct 152 arranged at the side of the door 140, namely, an outlet end, due to a flow state of the exhaust and because the exhaust duct 134 has a cross-sectional structure in which the cross-section at the outlet end of the exhaust duct 134 may be larger than the cross-section at the end of the exhaust duct 134 arranged at the side of the exhaust fan 152, namely, an inlet end.

As a result, the exhaust may strike the exhaust duct 134 or door 140, thereby causing heat transfer between the exhaust and the exhaust duct 134 or door 140. In this case, the cabinet may be heated because the temperature of the exhaust is relatively high. However, in the illustrated embodiment, a straight portion 134*a* may be formed at the outlet end of the exhaust duct 134, to limit diffusion of the exhaust at the outlet end of the exhaust duct 134 within a predetermined range. Accordingly, it is possible to effectively prevent the cabinet from being heated by the exhaust.

The straight portion 134*a* forms a straight flow region at the outlet end of the exhaust duct 134 arranged at the side of the door 140 when viewing in the flow direction of the exhaust. Accordingly, the exhaust flows straight while passing through the straight portion 134*a*, without being diffused.

A fan guide 153 may be arranged between the intake air fan 151 and the exhaust fan 152, to separate the intake air and exhaust from each other.

Figure 2:
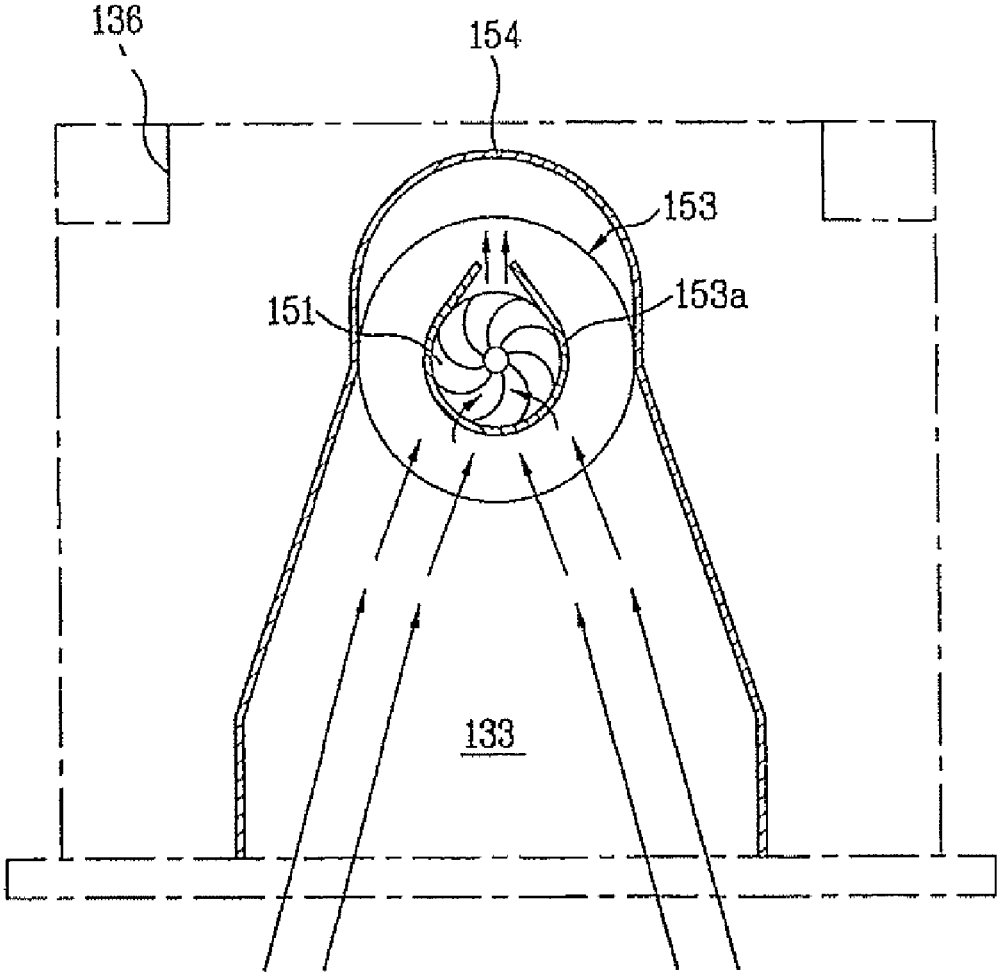
FIG. 2 is a plan view illustrating an intake air duct and an intake air fan shown in FIG. 1.
Figure 3:
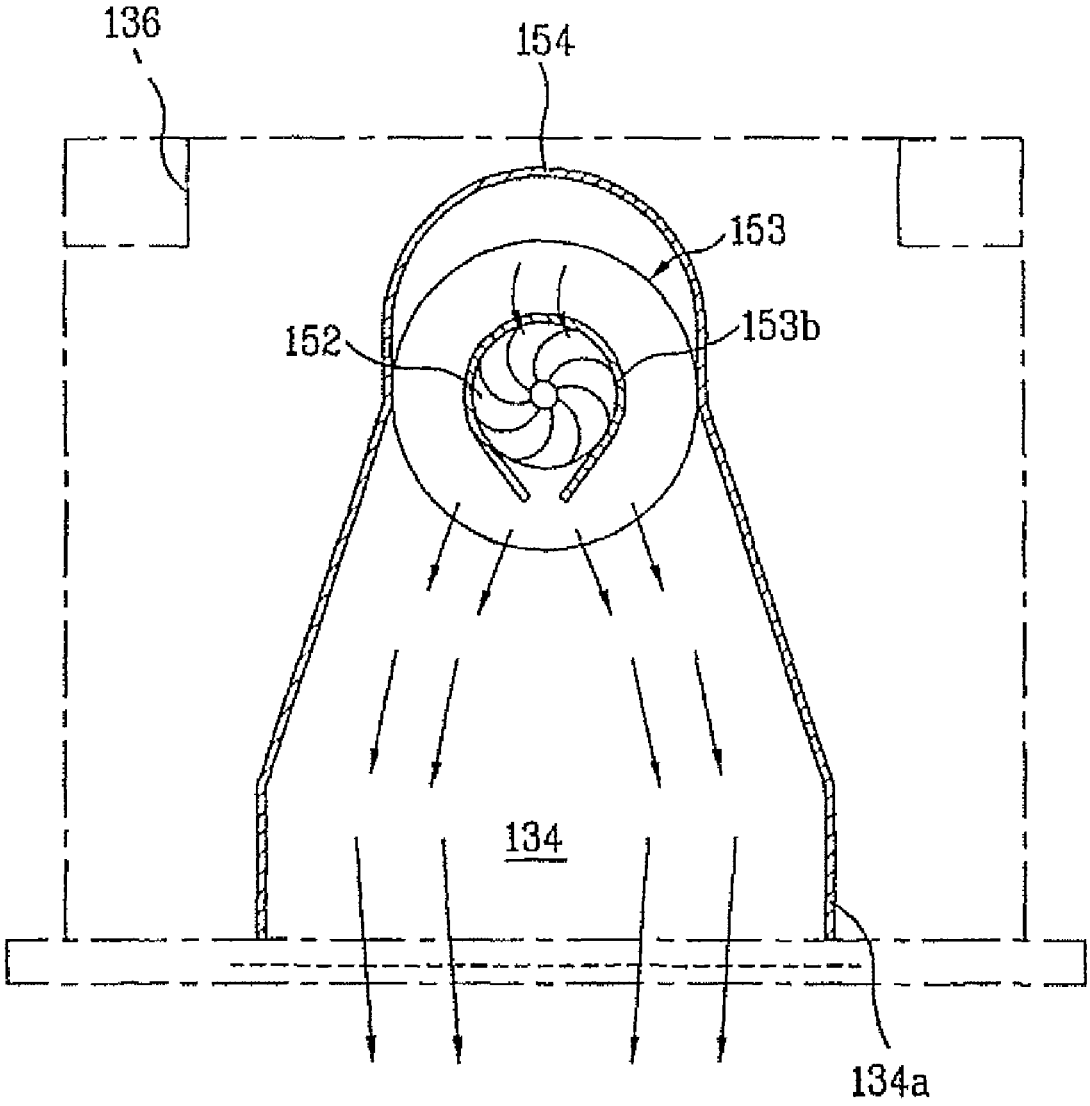
FIG. 3 is a plan view illustrating an exhaust duct and an exhaust fan shown in FIG. 1.

As shown in FIGS. 1 to 3, the fan guide 153 may be provided as a plate having a diameter larger than those of the intake air fan 151 and exhaust fan 152, and functions to support the intake air fan 151 and exhaust fan 152 while separating the intake air and exhaust from each other, in order to prevent the intake air and exhaust from being mixed.

A first flow guide 153*a* and a second flow guide 153*b* may be arranged around the intake air fan 151 and exhaust fan 152, respectively, in order to guide air discharged from the intake air fan 151 and exhaust fan 152 along desired paths, respectively, while preventing the discharged air from flowing backwardly.

Each of the flow guides 153*a* and 153*b* has a substantially-cylindrical structure having a certain height and a certain diameter so that it surrounds the associated intake air fan 151 or exhaust fan 152. Each of the flow guides 153*a* and 153*b* may be provided with an opening opened in an air discharge direction. The opening extends vertically throughout the height of the associated flow guide 153*a* or 153*b*, and has a certain width.

In detail, as shown in FIG. 2, the first flow guide 153*a* has a rearwardly-opened cylindrical structure to guide air discharged from the intake air fan 151 toward the exhaust fan 152. As shown in FIG. 3, the second flow guide 153*b* has a forwardly-opened cylindrical structure to guide air discharged from the exhaust air fan 152 toward the exhaust duct 133.

Of course, the structures of the flow guides 153*a* and 153*b* are not limited to the partially-opened cylindrical structure as described above.

Ambient air entering the intake air duct 133 may be introduced into the intake air fan 151 after overflowing the first flow guide 153*a*, and then discharged from the intake air fan 151 through the rear opening of the first flow guide 153*a*. Subsequently, the air flows along the inner wall surface of the fan housing 154, and then reaches the exhaust fan 152 arranged at an upper portion of the fan housing 154.

Thereafter, the air may be introduced into the exhaust fan 152 after overflowing the second flow guide 153*b*, and may then be discharged from the exhaust duct 134 through the front opening of the second flow guide 153*b*.

Hereinafter, flow passages for ambient air will be described with reference to FIGS. 1 to 4.

In accordance with this embodiment, the flow passages for ambient air include the first and second cooling flow passages A and B of the door 140, a bottom ambient air passage 135 extending along the bottom of the base plate 103, to guide ambient air introduced at the lower end of the door 140 to flow along the bottom of the base plate 103, rear intake air ducts 136 extending vertically along the back plate 102, and a front ambient air passage 132 extending from the ambient air intake louver 111 into the electric element chamber 130.

Of the flow passages for ambient air, the first and second cooling flow passages A and B function as main flow passages. That is, a large portion of the ambient air introduced into the cooking appliance may be guided by the first and second cooling flow passages A and B.

The first and second cooling flow passages A and B may be provided as flow passages for guiding ambient air introduced at the lower end of the door 140 to flow through the spaces defined among the outer glass 146 and intermediate glasses 147 and 148, and then to enter the intake air duct 133 at the upper end of the door 140.

The bottom ambient air passage 135 may be a flow passage for guiding the ambient air introduced at the lower end of the door 140 to flow toward the rear side of the cooking appliance through the space defined between the base plate 103 and the bottom of the cooking chamber 120, while cooling the cooking chamber 120 and the bottom of the cooking appliance.

The heater 121, which may be installed in the bottom of the cooking chamber 120, may be arranged relatively near the base plate 103. For this reason, the base plate 103, and thus, the cabinet, may be thermally deformed due to heat emitted from the heater 121.

When such a thermal deformation occurs at the base plate 103, there are problems associated with the performance and reliability of the product because the base plate 103 functions to the overall portion of the cooking appliance at the bottom.

To this end, in this embodiment, a bottom duct 103*a* having an inverted-U-shaped cross-section may be mounted to the base plate 103. The bottom duct 103*a* functions to concentratedly cool the base plate 103, and to prevent structures installed on the base plate 103 from interfering with the ambient air flowing along the base plate 103, and thus, to minimize the flow resistance of the air.

The bottom duct 103*a* not only secures a space providing the bottom ambient air passage 135, but also functions to support the bottom heater 121 and cooking chamber 120 at the bottom of the cooking chamber 120.

In detail, where the space defined between the cooking chamber 120 and the base plate 103 is used as the bottom ambient air passage 135 without installation of the bottom duct 103*a*, a non-uniform air flow is generated in the space. That is, the temperature distribution in the space is non-uniform due to a temperature difference between the central portion of the space corresponding to a region where the bottom heater 121 is arranged and the peripheral portion of the space relatively less influenced by the heater 121. As a result, the spacing between the cooking chamber 120 and the base plate 103 may be rendered non-uniform due to a thermal deformation difference between the central and peripheral portions of the base plate 103, thereby causing a flow of air in the space to be non-uniform.

In particular, there may be a problem in that it is difficult to secure a flow of air at the central portion of the space corresponding to the region where the bottom heater 121 is installed. In this embodiment, however, it is possible to eliminate air flow unbalance occurring between the central and peripheral portions of the space by installing the bottom duct 103*a*, and thus, uniformly maintaining the spacing between the cooking chamber 120 and the base plate 103.

Figure 4:
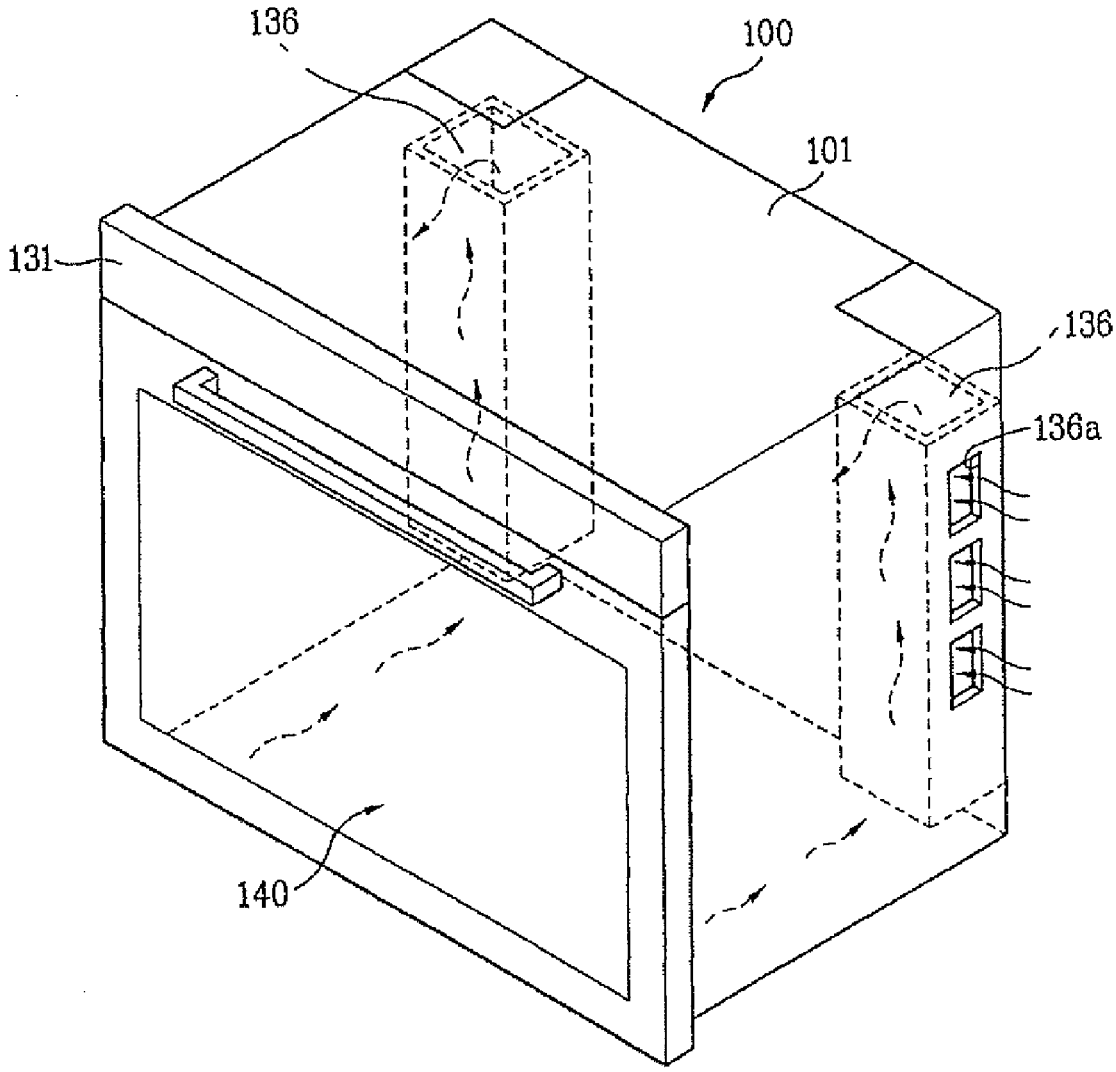
FIG. 4 is a perspective view schematically illustrating flow of air in a rear intake air duct shown in FIG. 1.
Figure 5A:
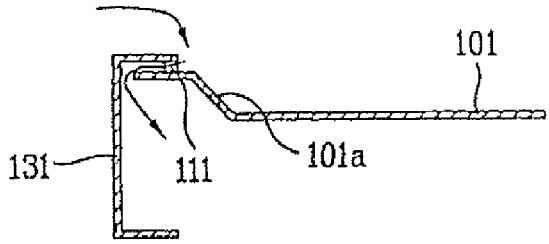
FIG. 5A is a sectional view schematically illustrating a first embodiment of coupling portions of a top plate and a control plate according to the present invention.
Figure 5B:
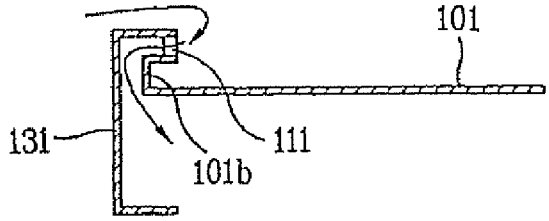
FIG. 5B is a sectional view schematically illustrating a second embodiment of the coupling portions of the top plate and control plate according to the present invention.
Figure 5C:
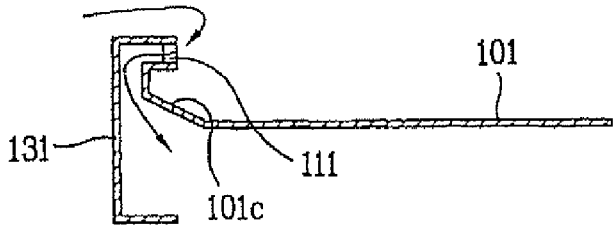
FIG. 5C is a sectional view schematically illustrating a third embodiment of the coupling portions of the top plate and control plate according to the present invention.
Figure 5D:
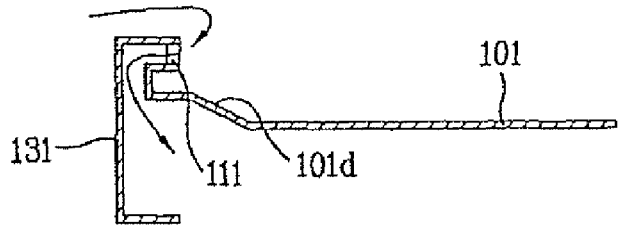
FIG. 5D is a sectional view schematically illustrating a fourth embodiment of the coupling portions of the top plate and control plate according to the present invention.

The rear intake air ducts 136 will be described in detail with reference to FIG. 4.

Each rear intake air duct 136 may be provided as a flow passage for guiding the ambient air emerging from the bottom ambient air passage 135 to the electric element chamber 130. Preferably, each rear intake air duct 136 is arranged at the rear side of the appliance body 100 while having a chimney shape such that it has the form of a space independent of the space defined between the back plate 102 and the rear wall of the cooking chamber 120.

In detail, the rear intake air ducts 136 may be arranged at opposite sides of the back plate 102, respectively, while being separated from the space defined between the back plate 102 and the rear wall of the cooking chamber 120. In particular, a cooling louver 136*a* may be formed at one side of each rear intake air duct 136, in order to allow ambient air to be directly introduced into the rear intake air duct 136.

In this case, accordingly, the ambient air introduced from the bottom ambient air passage 135 into each rear intake air duct 136 may be mixed with cooler ambient air introduced into the rear intake air duct 136 through the cooling louver 136*a* thereof. Thus, the electric element chamber 130 can be effectively cooled by the resultant air mixture.

In detail, the air emerging from the rear intake air ducts 136 cools the interior of the electric element chamber 130 while entering the fan housing 154 through a second intake louver 154*b* (i.e., a fan housing rear intake louver) formed at the fan housing 154.

Of course, each rear intake air duct 136 may be formed using the back plate 102 forming the rear wall of the appliance body 100 and the rear wall of the cooking chamber 120.

Ambient air may be introduced into the front ambient air passage 132 through the ambient air intake louver 111. The introduced air then cools the electric element chamber 130 while flowing toward the intake air fan 151 and exhaust fan 152 arranged downstream from the front ambient air passage 132. In particular, when the ambient air intake louver 111 is arranged at the front side of the cooking appliance, it is possible to effectively cool the elements installed at a front portion of the electric element chamber 130. More particularly, it is possible to effectively cool the control panel 131 and the elements mounted on the control panel 131.

The first intake louver 154*a* formed through the fan housing 154 forces the air present in the electric element chamber 130 to be discharged toward the exhaust duct 134. In accordance with such a forced air flow in the electric element chamber 130, the influence of the suction force of the intake air fan 151 and exhaust fan 152 may be increased, thereby increasing flow of air in the front ambient air passage 132, rear intake air duct 136, and thus, flow of air in the interior of the cooking appliance.

Hereinafter, embodiments of coupling portions of the top plate and control panel according to the present invention will be described with reference to FIGS. 5A to 5D.

As described above, the ambient air intake louver 111, which functions as an inlet for ambient air to be introduced into the electric element chamber 130 (FIG. 1), may be arranged in the region where the top plate 101 forming the top wall of the appliance body 100 and the control panel 131 may be coupled to each other.

The top plate 101 has a coupling end to be coupled to the control panel 131. In the embodiments of FIGS. 5A to 5D, the coupling end of the top plate 101 is designated by reference numerals 101*a*, 101*b*, 101*c*, and 101*d*, respectively. In each embodiment, the coupling end 101*a*, 101*b*, 101*c*, or 101*d* has a stepped structure, in order to prevent water from being externally introduced into the electric element chamber 130.

FIGS. 5A to 5D illustrate various shapes of the coupling end of the top plate, respectively. In each embodiment, the coupling end 101*a*, 101*b*, 101*c*, or 101*d* of the top plate 101 may protrude to a certain height, as compared to other portions of the top plate 101.

In detail, the coupling end 101*a*, 101*b*, 101*c*, or 101*d* of the top plate 101 extends in a substantially horizontal direction into the interior of the control panel 131 by a certain length in the region where the top plate 101 and the control panel 131 are coupled to each other, namely, the region where the ambient air intake louver 111 may be arranged.

The coupling end 101*a*, 101*b*, 101*c*, or 101*d* of the top plate 101 further extends in a vertical direction to form a stepped structure, in order to cause introduction of water into the electric element chamber 130 to be difficult. The coupling end

101*a*, 101*b*, 101*c*, or 101*d* of the top late 101 further extends in a horizontal direction to form a bent structure against a flow direction of the introduced water, in order to obstruct flow of the water. However, it should be appreciated that the coupling end and the top plate may be arranged having any suitable formed capable of preventing the ingress of undesirable substances, particles or debris.

As shown in FIGS. 5A to 5D, the coupling end of the top plate 101 may have various shapes as designated by reference numerals 101*a*, 101*b*, 101*c*, and 101*d*, and is not limited to the shapes shown in the drawings.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The above-described cooking appliance according to the present invention has the following effects.

First, it is possible to secure sufficient amounts of blown intake air and exhaust, and thus, to achieve an enhancement in the cooking efficiency of the cooking appliance, because double-suction type centrifugal fans driven by a single motor are used for the intake air fan and exhaust fan.

Second, the effect of cooling the electric element chamber can be maximized because ambient air is directly introduced into the electric element chamber at the front and rear sides thereof in accordance with provision of the ambient air intake louver at the top plate and provision of the rear intake air ducts at the back plate.

Third, the performance for cooling the bottom structure including the base plate can be enhanced because the bottom ambient air passage is formed beneath the base plate, to allow ambient air to flow along the base plate.

Fourth, the blowing performances of the intake air fan and exhaust fan can be enhanced by virtue of the flow guides preventing air discharged from the intake air fan and exhaust fan from flowing backwardly.

Fifth, it is possible to prevent the cabinet from being damaged due to heat because air flowing through the exhaust duct is straight-forwardly discharged out of the exhaust duct by the straight portion formed at the outlet end of the exhaust duct.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A cooking appliance comprising:

an appliance body including a cooking chamber to cook food;

a door that opens and closes the cooking chamber, the door having cooling flow passages that absorb heat transferred from the cooking chamber;

an intake air duct that communicates with the cooling flow passages, the intake air duct being provided proximate a top side of the cooking chamber;

an exhaust duct that communicates with the intake air duct, the exhaust duct being provided proximate the intake air duct; and a fan-motor assembly provided in a space formed by the intake air duct and the exhaust duct such that the fan-motor assembly forms a portion of a connecting passage that connects the intake air duct and the exhaust duct, wherein the fan-motor assembly comprises:

an intake air fan provided in the intake air duct;

an exhaust fan provided in the exhaust duct;

a bi-axial motor that drives the intake air fan and the exhaust fan; and a fan housing that forms the connecting passage, and receives the exhaust fan and the intake air fan therein;

an electric element chamber provided above the cooking chamber, and configured to receive elements which operate the cooking appliance; and a fan housing front intake louver configured to allow communication between an interior of the fan housing and the electric element chamber.

2. The cooking appliance according to claim 1, wherein the intake air duct and the exhaust duct are positioned vertically in relation to each other to form a layered structure.

3. The cooking appliance according to claim 1, wherein the exhaust duct has a generally straight portion having a length extending in a forward direction to an outlet end of the exhaust duct.

4. The cooking appliance according to claim 1, wherein the fan-motor assembly further comprises flow guides surrounding the intake air fan and the exhaust fan, respectively.

5. The cooking appliance according to claim 1, wherein the fan-motor assembly further comprises a fan guide provided between the intake air fan and the exhaust fan, wherein the fan guide separates air introduced into the intake air fan and air introduced into the exhaust fan from each other.

6. The cooking appliance according to claim 1, further comprising:

a rear intake air duct provided between a back plate that forms a rear wall of the appliance body and a rear wall of the cooking chamber.

7. The cooking appliance according to claim 6, wherein the rear intake air duct has an inner space separate from a space formed between the back plate and the rear wall of the cooking chamber.

8. The cooking appliance according to claim 6, further comprising:

a fan housing rear intake louver configured to allow communication between the rear intake air duct and an inner space of the fan housing.

9. The cooking appliance according to claim 6, wherein the rear intake air duct has a cooling louver configured to allow communication between an inner space of the rear intake air duct and ambient air.

10. The cooking appliance according to claim 6, further comprising:

a bottom duct provided beneath a bottom surface of the cooking chamber, wherein the bottom duct is configured to allow communication between ambient air and the rear intake air duct.

11. The cooking appliance according to claim 1, further comprising:

an ambient air intake louver providing an introduction passage to guide ambient air into the electric element chamber through an upper portion of the electric element chamber.

12. The cooking appliance according to claim 11, wherein the ambient air intake louver is provided between a control panel mounted to a front wall of the electric element chamber and a top plate that forms a top wall of the electric element chamber.

13. The cooking appliance according to claim 12, wherein the top plate has a stepped end located proximate the ambient air intake louver.

14. The cooking appliance according to claim 1, wherein the door comprises a door frame, and a plurality of spaced glasses fitted in the door frame, and wherein the cooling flow passages are formed by the plurality of glasses and the door frame.

15. The cooking appliance according to claim 1, further comprising:

a fan housing rear intake louver configured to allow communication between a rear intake air duct and an inner space of the fan housing.

16. The cooking appliance according to claim 15, wherein the fan housing front intake louver and the fan housing rear intake louver are both provided on an outer surface of the fan housing.

17. The cooking appliance according to claim 16, wherein the fan housing front intake louver is located closer to an exhaust duct outlet than the fan housing rear intake louver.

* * * * *